US006532620B2

(12) United States Patent
Oh

(10) Patent No.: US 6,532,620 B2
(45) Date of Patent: Mar. 18, 2003

(54) CYCLONE DUST COLLECTING CHAMBER FOR A VACUUM CLEANER

(75) Inventor: Jang-Keun Oh, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 0 days.

(21) Appl. No.: 09/809,607

(22) Filed: Mar. 14, 2001

(65) Prior Publication Data

US 2002/0046438 A1 Apr. 25, 2002

(30) Foreign Application Priority Data

Oct. 19, 2000 (KR) ..... 2000-61534

(51) Int. Cl.[7] ..... A47L 9/16

(52) U.S. Cl. ..... 15/353; 15/350; 15/352; 55/327; 55/DIG. 3

(58) Field of Search ..... 15/350, 352, 353; 55/327, DIG. 3

(56) References Cited

U.S. PATENT DOCUMENTS

| | | | | | |
|---|---|---|---|---|---|
| 3,320,727 | A | * | 5/1967 | Farley et al. | 15/353 |
| 5,230,722 | A | * | 7/1993 | Yonkers | 15/353 |
| 5,779,745 | A | | 7/1998 | Kilstrom | 55/337 |
| 6,070,291 | A | * | 6/2000 | Bair et al. | 15/353 |
| 6,141,826 | A | * | 11/2000 | Conrad et al. | 15/353 |
| 6,146,434 | A | * | 11/2000 | Scalfani et al. | 15/353 |
| 6,168,641 | B1 | * | 1/2001 | Tuvin et al. | 55/DIG. 3 |
| 6,260,234 | B1 | * | 7/2001 | Wright et al. | 15/350 |
| 6,269,518 | B1 | * | 8/2001 | Yung | 15/352 |
| 6,334,234 | B1 | * | 1/2002 | Conrad et al. | 15/350 |
| 6,341,404 | B1 | * | 1/2002 | Salo et al. | 15/350 |
| 6,406,505 | B1 | * | 6/2002 | Oh et al. | 15/353 |

FOREIGN PATENT DOCUMENTS

| | | |
|---|---|---|
| GB | 2 321 181 | 7/1998 |
| WO | WO 99/34722 | 7/1999 |

* cited by examiner

*Primary Examiner*—Theresa T. Snider
(74) *Attorney, Agent, or Firm*—Ladas & Parry

(57) ABSTRACT

An upright-type vacuum cleaner includes a cleaner body, a suction brush, cyclone dust collecting apparatus, and a filter. The cyclone dust collecting apparatus is removably disposed in a dust collecting chamber in the cleaner body. The suction brush draws air and contaminants from a surface to be cleaned into the cleaner body. The cyclone dust collecting apparatus induces the air and contaminants into a vortex to separate by centrifugal force large particle contaminants from the air and to collect the contaminants. The filter further filters fine contaminants from the air that is discharged from the cyclone dust collecting apparatus.

11 Claims, 3 Drawing Sheets

CYCLONE DUST COLLECTING CHAMBER FOR A VACUUM CLEANER

BACKGROUND OF THE INVENTION

1. Field of the Invention

This invention relates to an upright-type vacuum cleaner, and more particularly, to a cyclone dust collecting apparatus for the upright vacuum cleaner, which uses centrifugal force to collect contaminants from the air that is drawn into the vacuum cleaner.

2. Description of the Related Art

Generally, an upright-type vacuum cleaner includes a suction brush that is movably connected to a cleaner body. The suction brush moves along a cleaning surface during the cleaning process. The cleaner body includes a dust collecting chamber having a detachable dust filter disposed therein, and a motor operating chamber having a motor for generating a suction force. When the motor operates, it generates a strong suction force at the suction brush. Accordingly, contaminants, such as dust or dirt, on the cleaning surface are drawn in together with air into the cleaner body. The contaminants entrained in the air are filtered through the dust filter that is disposed in the dust collecting chamber of the cleaner body, and the clean air is discharged back into the room through the motor operating chamber.

Conventional vacuum cleaners, however, collect contaminants with the use of a consumable dust filter. When the dust filter is filled with contaminants, the dust filter must be replaced manually. Manual replacement of a dust filter is inconvenient and can result in poor sanitation conditions.

SUMMARY OF THE INVENTION

The present invention has been made to overcome the above-mentioned problems of the related art. Accordingly, it is an object of the present invention to provide a cyclone dust collecting apparatus for an upright-type vacuum cleaner for centrifuging and collecting contaminants from the air that is drawn into the vacuum cleaner through a suction brush.

The above object is accomplished by a cyclone dust collecting apparatus for the vacuum cleaner comprising a cleaner body, a suction brush, cyclone dust collecting means, and filtering means. The cleaner body includes a dust collecting chamber having an air intake port and an air discharge port, a motor operating chamber having a motor, and an air discharge path for communication between the dust collecting chamber and the motor operating chamber. The suction brush is pivotally connected to the cleaner body and moves along the cleaning surface, drawing in air and contaminants by a suction force generated by the motor. The cyclone dust collecting means, which is detachably mounted in the dust collecting chamber, inducing the air into a vortex, thereby separating by centrifugal force larger particle contaminants from the air and collecting the separated contaminants. The filtering means is removably disposed in the air discharge path to filter out fine contaminants from the air, which flows from the cyclone dust collecting means into the motor operating chamber.

The cyclone dust collecting means includes a cyclone body having a centrifuging body for inducing the air and contaminants that are drawn into an upper open end of the cyclone body into a vortex and separating the contaminants from the air by centrifugal force. The cyclone dust collecting means further includes a dust receptacle for collecting and storing the separated contaminants, and a cover removably coupled to the open upper end of the cyclone body. The cover includes an air intake channel and an air discharge channel. The air intake channel communicates with the air intake port of the dust collecting chamber, and the air discharge channel communicates with the air discharge port.

The filtering means includes a filter and a filter case. The filter case, is detachably disposed between the dust collecting chamber and the motor operating chamber, receives the filter and has an opening, which communicates with the air discharge path, and vents which communicate with the motor operating chamber.

BRIEF DESCRIPTION OF THE DRAWINGS

The above object and other features and advantages of the present invention will be clarified by the following detailed description and the attached drawings, in which.

DETAILED DESCRIPTION OF THE PREFERRED EMBODIMENT

Figure 1:
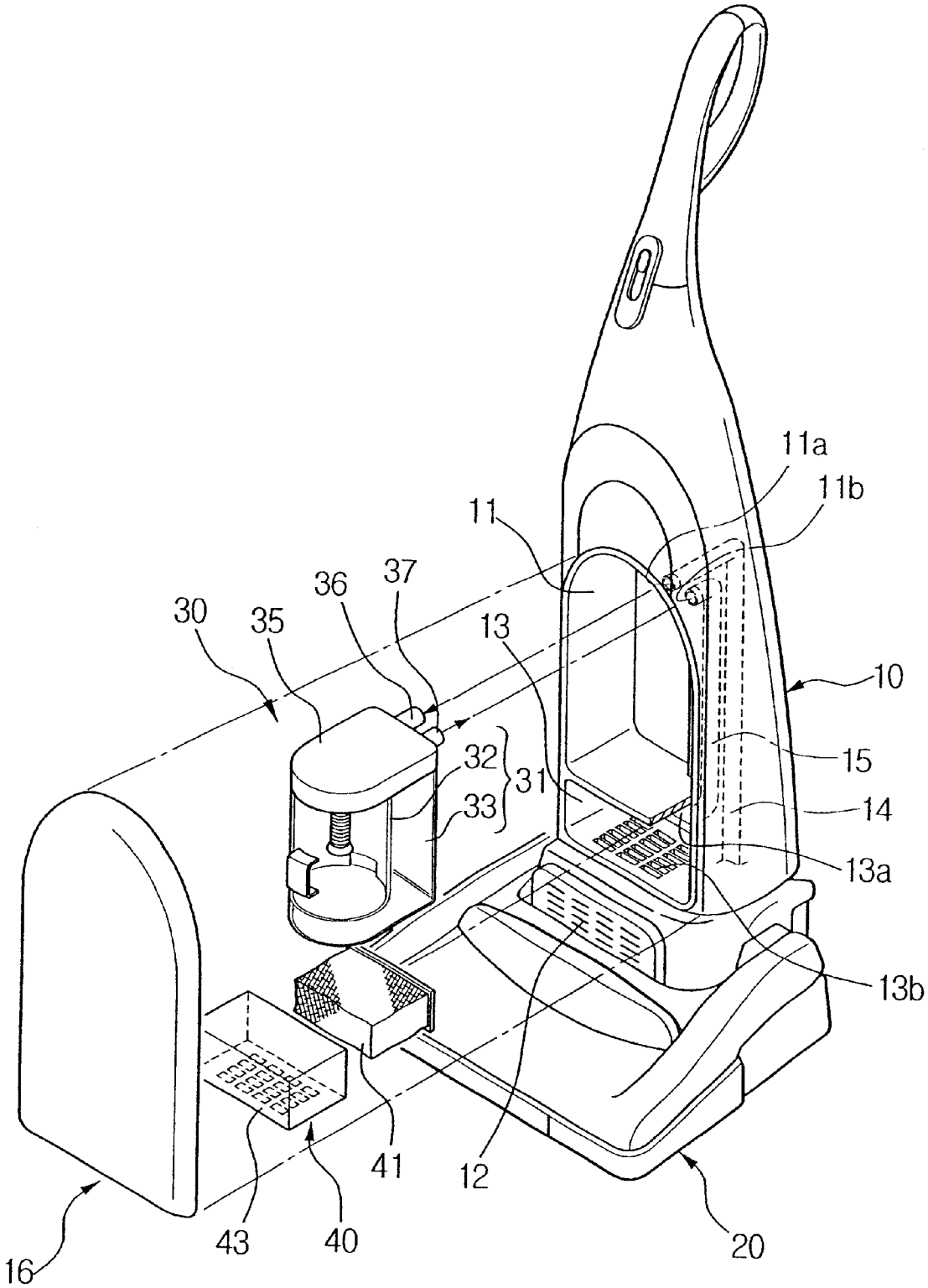
FIG. 1 is a partially exploded perspective view of an upright-type vacuum cleaner having a cyclone dust collecting device in accordance with a preferred embodiment of the present invention.

Referring to FIG. 1, an upright-type vacuum cleaner includes a cleaner body 10, a suction brush 20 movably connected to a lower portion of the cleaner body 10, a cyclone dust collecting device 30 removably mounted in the cleaner body 10, and a filtering device 40 for filtering fine contaminants.

The cleaner body 10 has a dust collecting chamber 11, in which the cyclone dust collecting device 20 is mounted, a motor operating chamber 12, in which a motor (not shown) is installed, and a filtering chamber 13, in which the filtering device 40 is removably mounted. An air intake port 11*a* and an air discharge port 11*b* are formed in the dust collecting chamber 11. The air intake port 11*a* communicates with the suction brush 20 through an air intake path 14 disposed in the cleaner body 10. Accordingly, contaminants entrained in the air that is drawn in through the suction brush 20 are drawn into the air intake port 11*a* via the air intake path 14. The air discharge port 11*b* communicates with the motor operating chamber 12 via an air discharge path 15, also disposed in the cleaner body 10. That is, the air discharge path 15 communicates with the motor operating chamber 12 through the filtering chamber 13. Accordingly, the air is discharged through the air discharge port 11*b*, air discharge path 15, the filtering chamber 13, the motor operating chamber 12, and into the room. The filtering chamber 13 has an air inlet 13*a* that corresponds to the air discharge path 15 and air outlets 13*b* that correspond to the motor operating chamber 12. The air inlet 13*a* is formed in a side of the filtering chamber 13, and the air outlets 13*b* are formed in the bottom of the filtering chamber. A front cover 16 is detachably disposed in front of the cleaner body 10 for opening and closing the dust collecting chamber 11 and the filtering chamber 13.

The suction brush 20 is movably disposed at a lower portion of the cleaner body 10 and moves along the cleaning surface during the cleaning process. The suction brush 20 draws into the vacuum cleaner air and contaminants, such as dust or dirt, by a suction force generated by the motor of the motor operating chamber 12.

Figure 2:
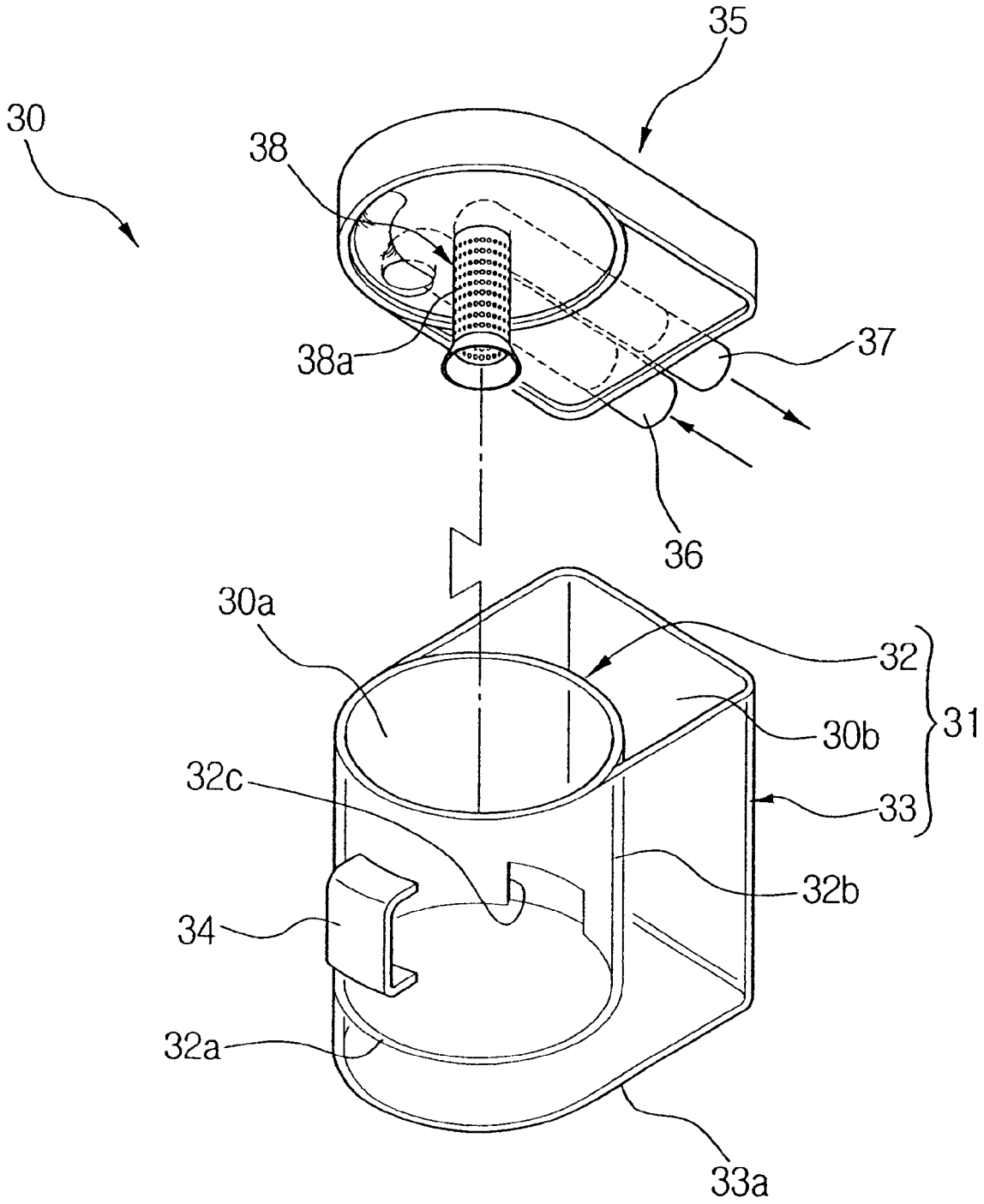
FIG. 2 is a perspective view of the cyclone dust collecting device of FIG. 1.

Referring to FIG. 2, the cyclone dust collecting device 30 includes a cyclone body 31 and a cover 35 removably coupled to the cyclone body 31. The cyclone body 31 has a centrifuging portion 30*a* and a dust receiving portion 30*b*.

The centrifuging portion 30*a* has a cylindrical centrifuging body 32. The dust receiving portion 30*b* has a dust receptacle 33 that is disposed next to the centrifuging body 32. The centrifuging body 32 has an open upper end, a base 32*a*, and a cylindrical wall 32*b*. The cylindrical wall 32*b* extends from the base 32*a* to the open upper end. The centrifuging body 32 further includes a dust discharge port 32*c* that is formed at a lower portion of the cylindrical wall 32*b*.

In operation, air is drawn from the upper end of the centrifuging body 32, together with contaminants and induced into a vortex along the cylindrical wall 32*b*. The contaminants are then separated from the air by centrifugal force and discharged through the dust discharge hole 32*c* to the dust receptacle 33. The dust receptacle 33 surrounds the base 32*a* and the cylindrical wall 32*b* of the centrifuging body 32. Here, a bottom 33*a* of the dust receptacle 33 and the base 32*a* of the centrifuging body 32 are spaced apart by a predetermined distance. The contaminants that are discharged through the dust discharge hole 32*c* accumulate on the bottom 33*a* of the dust receptacle 33 and do not return to the centrifuging body 32. It is preferable that the centrifuging body 32 and the dust receptacle 33 are made of a transparent plastic material to facilitate monitoring of the level of contaminants in the cyclone body 31. It is further preferable that the centrifuging body 32 and dust receptacle 33 are integrally formed. A handle 34 is disposed on an outer circumference of the cyclone body 31 to facilitate easier handling of the cyclone body 31.

The cover 35 of the cyclone dust collecting device 30 has an air intake channel 36, which corresponds to the air intake port 11*a*, and an air discharge channel 37, which corresponds to the air discharge port 11*b*.

As air is drawn through the air intake port 11*a*, the air is diagonally guided by the air intake channel 36 to the centrifuging portion 30*a*. In the centrifuging portion 30*a*, larger particle contaminants are removed from the air, and the cleaner air is discharged through the air discharge channel 37. The air discharge channel 37 is disposed at a center of the cover 35, thereby corresponding approximately to a center portion of the centrifuging portion 30*a*. It is preferable that the air intake channel 36 has a larger diameter than that of the air discharge channel 37, since the air flowing through the air intake channel 36 contains contaminants, while the cleaner air flowing through the air discharge channel 37 does not.

A grill 38, which communicates with the air discharge channel 37, is disposed on the cover 35 to filter contaminants. The grill 38 has a predetermined height and extends from the lower surface of the cover 35 into the centrifuging portion 30*a*. The grill has a plurality of through holes 38*a* formed therein for filtering large particles of contaminants.

Figure 3:
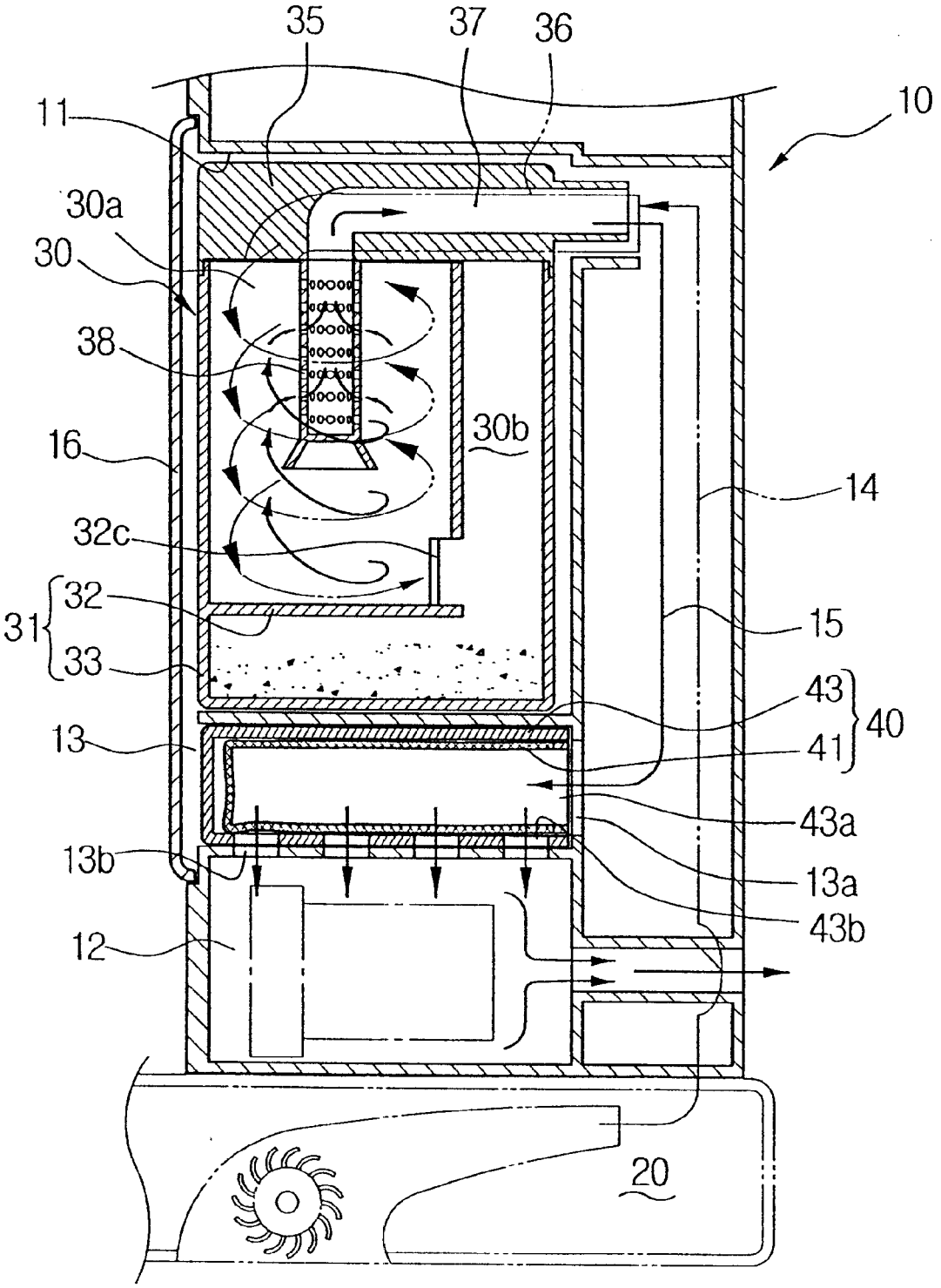
FIG. 3 is a partial sectional view of the upright-type vacuum cleaner of FIG. 1 in an assembled state.

Referring to FIGS. 1 and 3, the filtering device 40 will now be described. The filtering device 40 has a filter 41 and a filter case 43. The filter 41 has a plurality of fine through holes for filtering fine contaminants that were not collected in the cyclone dust collecting device 30. The filter 41 is widely used in conventional vacuum cleaners, and, thus, a detailed description of the filter 41 will be omitted. The filter case 43 in which the filter 41 is inserted, is detachably disposed in the filtering chamber 13. The filter case 43 has an opening 43*a*, which corresponds to the air inlet 13*a*. The air inlet 13*a* in turn communicates with the air discharge path 15. The filter case 43 further includes vents 43*b*, which correspond to the air outlets 13*b* leading to the motor operating chamber 12.

The operation of the upright-type vacuum cleaner of the present invention as constructed above with the cyclone dust collecting apparatus will be described in detail hereinafter.

When the motor of the motor operating chamber 12 operates, a suction force is generated at the suction brush 20. Air along with contaminants on the cleaning surface are drawn into the cyclone dust collecting device 30 through the suction brush 20 and air intake path 14 by the suction force. In the cyclone body 31 of the cyclone dust collecting device, the air intake channel 36 of the cover 35 diagonally guides the air and induces the air into a vortex along the interior of the centrifuging body 32. Then, larger particles of contaminants are separated from the air by centrifugal force and are discharged through the dust discharge hole 32*c*. The discharged contaminants are collected and stored at the bottom 33*a* of the dust receptacle 33. Because the centrifuging body 32 is located above the dust receptacle 33, contaminants in the dust receptacle 33 cannot return to the centrifuging body 32 through the dust discharge hole 32*c*.

The cleaner air, from which the larger particle contaminants have been removed, is discharged from the centrifuging body 32 through the through holes 38*a* of the grill 38 and the air discharge channel 37. The cleaner air proceeds through the air discharge path 15 to the filter case 43 of the filtering device 13. There, fine contaminants, which were not collected in the cyclone dust collecting device 30, are removed from the air by the filter 41. The filtered air is then discharged through the motor operating chamber 12 back into the environment.

The present invention improves the dust collecting efficiency of the vacuum cleaner, by first collecting larger particle contaminants with the cyclone dust collecting device 30 and then collecting fine contaminants with the filter 41.

In addition, since the contaminants that have been separated from the air in the cyclone dust collecting device 30 are collected in the dust receptacle 33, a backflow of the contaminants is prevented, thereby resulting in a high dust collecting efficiency.

When the dust receptacle 33 is filled with contaminants, the front cover 16 may be detached from the cleaner body 10 to provided access to the cyclone dust collecting device 30. The cyclone dust collecting device 30 can be detached from the dust collecting chamber 11, and the cover 35 removed from the cyclone body 31, exposing the open upper end of the cyclone body 31. When the cyclone body 31 is turned upside down, the contaminants in the dust receptacle 33 may be removed. The cyclone dust collecting device 30 is then re-assembled and mounted in the dust collecting chamber 11 for use.

When the filter 41 is filled with fine contaminants, the filter case 41 is detached from the filtering chamber 13, the filter 41 is removed from the filter case 41, and the fine contaminants are shaken off of the filter 41. The filter 41 and filter case 41 are then re-assembled and mounted in the dust collecting chamber 11. Alternatively, the filter 41 may be replaced with a new filter when it is filled with fine contaminants.

In the upright-type vacuum cleaner of to the present invention, since the cyclone dust collecting device 30 collects contaminants using the dust receptacle 33 that is disposed below the centrifuging body 32, contaminants do not return from the dust receptacle 33 to the centrifuging body 32.

Also, since the cyclone dust collecting device 30 initially collects large particles of contaminants, and the filtering device 40 later collects fine contaminants, the dust collecting efficiency of the vacuum cleaner is enhanced.

The present invention has been particularly shown and described with reference to the preferred embodiment thereof. It will be understood by those skilled in the art that various changes in form and detail may be effected therein without departing from the spirit and scope of the invention as defined by the appended claims.

What is claimed is:

1. An upright-type vacuum cleaner comprising:

a cleaner body including:

a dust collecting chamber having an air intake port and an air discharge port;

a motor operating chamber; and an air discharge path for connecting the air discharge port of the dust collecting chamber with the motor operating chamber;

a suction brush connected to the cleaner body for drawing in air and contaminants into the cleaner body;

cyclone dust collecting means detachably mounted in the dust collecting chamber, the cyclone dust collecting means being capable of inducing the air and contaminants into a vortex to separate larger particle contaminants from the air and collecting the separated contaminants, the cyclone dust collecting means being connected to the air intake port of the dust collecting chamber and having an open upper end and being comprised of two separate, interconnected portions, a centrifuging body portion that induces the air and contaminants into the vortex to separate larger particle contaminants from the air and a separate dust receptacle portion, removed from the centrifuging body portion, for collecting and storing the separated contaminants; and a cover removably coupled to the open upper end of the cyclone dust collecting means, the cover including an air intake channel and an air discharge channel, the air intake channel communicating with the air intake port of the dust collecting chamber, and the air discharge channel communicating with the air discharge port; and filtering means removably disposed in the air discharge path, the filtering means removing fine contaminants from the air.

2. The upright-type vacuum cleaner as claimed in claim 1, wherein the centrifuging body portion includes an open upper end, a base, and a cylindrical wall, the cylindrical wall having a dust discharge hole formed therein, and wherein the dust receptacle portion abuts at least a portion of the cylindrical wall and the base of the centrifuging body portion to allow for collection of the separated contaminants.

3. The upright-type vacuum cleaner as chimed in claim 2, wherein the air intake channel is tubular and has a larger diameter than a diameter of the air discharge channel, which is also tubular.

4. The upright-type vacuum cleaner as claimed in claim 1, wherein the cover includes a grill, the grill extending downward from the cover into an upper portion of the centrifugal body portion, the grill having a plurality of through holes formed therein, the through holes communicating with the air discharge path.

5. The upright-type vacuum cleaner as claimed in claim 1, wherein the cleaner body further includes a filtering chamber, the filtering means being removably mounted in the filtering chamber, the filtering chamber being located between the dust collecting chamber and the motor operating chamber and having an air inlet in communication with the an discharge path and at least one air outlet in communication with the motor operating chamber.

6. The upright-type vacuum cleaner as claimed in claim 1, wherein the filtering means comprises a filter and a filter case detachably disposed between the dust collecting chamber and the motor operating chamber far receiving the filter, the filter case having an opening in communication with the air discharge path, and a vent in communication with the motor operating chamber.

7. The upright-type vacuum cleaner as claimed in claim 5, wherein the filtering means comprises a filter and a filter case detachably disposed in the filtering chamber, the filter case having an opening corresponding to the air inlet, and a vent corresponding to the at least one air outlet.

8. An upright-type vacuum cleaner comprising:

a cleaner body including:

a dust collecting chamber having an air intake port and an air discharge port;

a motor operating chamber; and an air discharge path for connecting the air discharge port of the dust collecting chamber with the motor operating chamber;

a suction brush connected to the cleaner body for drawing in air and contaminants into the cleaner body;

cyclone dust collecting means detachably mounted in the dust collecting chamber, having an open upper end and being connected to the air intake port of the dust collecting chamber and being comprised of two separate, interconnected portions, a centrifuging body portion that induces the air and contaminants into the vortex to separate larger particle contaminants from the air and a separate dust receptacle portion, removed from the centrifuging body portion, for collecting and storing the separated contaminants, the cyclone dust collecting means separating the contaminants from the air and sending the contaminants to the dust receptacle portion, the dust receptacle portion collecting and storing the separated contaminants in a space removed from the centrifuging body portion; and filtering means removably disposed in the air discharge path, the filtering means removing fine contaminants from the air.

9. The upright-type vacuum cleaner as claimed in claim 8, wherein the cyclone dust collecting means further comprises:

a cover removably coupled to the open upper end of the cyclone dust collecting means, the cover including an air intake channel and an air discharge channel, the air intake channel communicating with the air intake port of the dust collecting chamber, and the air discharge channel communicating with the air discharge port.

10. The upright-type vacuum cleaner as claimed in claim 9, wherein the centrifuging body portion includes an open upper end, a base, and a cylindrical wall, the cylindrical wall having a dust discharge hole formed therein, and wherein the dust receptacle portion abuts at least a portion of the cylindrical wall and the base of the centrifuging body portion to allow for collection of the separated contaminants.

11. The upright-type vacuum cleaner as claimed in claim 9, wherein the air intake channel is tubular and has a larger diameter than a diameter of the air discharge channel, which is tubular.

* * * * *